US009208732B2

(12) United States Patent
Kim et al.

(10) Patent No.: US 9,208,732 B2
(45) Date of Patent: Dec. 8, 2015

(54) LIQUID CRYSTAL DISPLAY DEVICE AND ITS DRIVING METHOD

(75) Inventors: JongWoo Kim, Paju-si (KR); MyungKook Moon, Daegu (KR)

(73) Assignee: LG DISPLAY CO., LTD., Seoul (KR)

( * ) Notice: Subject to any disclaimer, the term of this patent is extended or adjusted under 35 U.S.C. 154(b) by 528 days.

(21) Appl. No.: 13/551,116

(22) Filed: Jul. 17, 2012

(65) Prior Publication Data

US 2013/0050176 A1 Feb. 28, 2013

(30) Foreign Application Priority Data

Aug. 25, 2011 (KR) ..... 10-2011-0084955

(51) Int. Cl.
*G09G 3/36* (2006.01)

(52) U.S. Cl.
CPC ..... *G09G 3/36* (2013.01)

(58) Field of Classification Search
CPC ..... G09G 3/36; G09G 3/038
USPC ..... 345/214, 87
See application file for complete search history.

(56) References Cited

U.S. PATENT DOCUMENTS

2003/0011557 A1 1/2003 Koga et al.
2003/0098838 A1* 5/2003 Minami ..... 345/87
2004/0227716 A1 11/2004 Lin
2007/0126686 A1 6/2007 Chang et al.
2007/0165127 A1 7/2007 Minami
2007/0229418 A1 10/2007 Yun et al.
2008/0106542 A1 5/2008 Park et al.
2008/0129761 A1 6/2008 Kim et al.
2008/0291189 A1 11/2008 Song et al.
2009/0096769 A1* 4/2009 Kim et al. ..... 345/204
2010/0148829 A1 6/2010 Hong et al.
2010/0225637 A1* 9/2010 Jeon et al. ..... 345/213
2010/0265246 A1 10/2010 Chen
2011/0181558 A1 7/2011 Jeon et al.
2011/0242066 A1* 10/2011 Jeon et al. ..... 345/204

FOREIGN PATENT DOCUMENTS

DE 102009034851 A1 6/2010
KR 20070079103 A 8/2007
KR 20070080170 A 8/2007

* cited by examiner

*Primary Examiner* — Sahlu Okebato
(74) *Attorney, Agent, or Firm* — Brinks Gilson & Lione

(57) ABSTRACT

An LCD device includes a driver and a timing controller. The driver includes at least one or more gate driving IC for outputting a scan signal to a plurality of gate lines of a panel, and at least one or more data driving IC for respectively outputting a plurality of image data signals to a plurality of data lines of the panel. The timing controller determines whether a current mode is an abnormal mode in which the panel outputs an abnormal image by using at least one or more lock signals, outputs a driver control signal generated for controlling the driver when the current mode is determined as a normal mode, and outputs a masking control signal, which makes the panel not to output the abnormal image, to the driver when the current mode is determined as the abnormal mode.

20 Claims, 7 Drawing Sheets

LIQUID CRYSTAL DISPLAY DEVICE AND ITS DRIVING METHOD

This application claims the priority and the benefit under 35 U.S.C. §119(a) on Korean Patent Application No. 10-2011-0084955 filed on Aug. 25, 2011, the entire contents of which are hereby incorporated by reference.

BACKGROUND

1. Field of the Invention

The present disclosure relates to a Liquid Crystal Display (LCD) device, and more particularly, to an LCD device and a driving method thereof, which can prevent abnormal image data from being outputted when an abnormal signal is inputted thereto.

2. Discussion of the Related Art

LCD devices are devices that adjust the light transmittance of liquid crystal cells according to image data signals. The LCD devices are thin and light, and have low power consumption. Therefore, the LCD devices are being widely applied to various devices such as computer monitors, notebook computers, portable terminals, and wall-mounted televisions.

Generally, such LCD devices include a panel that display an image, a gate driving Integrated Chip (IC), a data driving IC, and a timing controller.

FIG. 1 is a timing diagram showing input signals and output signals of a related art timing controller, and shows the outputs of various control signals based on a dot clock DCLK and a data enable signal DE that are inputted to the timing controller.

Generally, the timing controller configuring the LCD device is connected to an external system through an interface using Low Voltage Differential Signaling (LVDS), and is connected to the data driving ICs of a data driver by using a point-to-point scheme.

The timing controller generates a gate control signal GCS and a data control signal DCS with a timing signal (for example, Vsync, Hsync, and DCLK) that is transferred from the external system, and respectively transfers the gate control signal GCS and the data control signal DCS to the gate driving IC and the data driving IC.

The timing controller aligns video data transferred from the external system to supply image data to the data driving IC.

The timing controller uses a Phase Locked Loop (PLL) for adjusting clocks and a frequency (phase) that are used in the external system or the data driving IC.

That is, an LVDS reception unit of the timing controller includes a PLL, and thus, the PLL locks the constant frequency (phase) of a signal received from the external system to the LVDS reception unit and the constant frequency (phase) of a signal outputted from the LVDS reception unit. Also, an Embedded Clock Point-Point Interface (EPI) transfer unit inside the timing controller includes a PLL, and thus, the PLL locks the constant frequencies (phases) of clocks that are used inside the timing controller. Furthermore, each of the data driving ICs uses a PLL for implementing the point-to-point scheme between the timing controller and each data driving IC.

However, due to various causes, a transition can occur in the lock of the PLL. When such an abnormal transition occurs, the timing controller transfers abnormal driver control signals (particularly, an abnormal gate control signal GCS) to the gate driving IC, and thus, the panel can output an abnormal image or cannot normally operate.

Such abnormal operations can occur in the following cases.

First, since the PLL of the LVDS reception unit of the timing controller is unlocked, an abnormal operation can occur.

For example, as shown in FIG. 1A, when the frame frequency of the dot clock DCLK is arbitrarily changed from 60 Hz to 40 Hz for switching a mode, the lock of the PLL of the LVDS reception unit is released, and thus, the frequency of a data enable signal "Output DE" outputted from the LVDS reception unit is not matched with that of a data enable signal "Input DE" inputted from the LVDS reception unit, causing a glitch. In this case, the timing controller that transfers the gate control signal to the gate driving IC outputs an abnormal gate start pulse GSP and an abnormal gate shift clock GSC, causing the abnormal driving of the panel.

Moreover, as shown in FIG. 1B, even when the timing signal (for example, DCLK or the like) transferred from the external system is abnormally inputted to the timing controller, the lock of the PLL of the LVDS reception unit is released. In this case, the timing controller that transfers the gate control signal to the gate driving IC using a Gate-In-Panel (GIP) type outputs an abnormal gate start signal VST and an abnormal gate clock GCLK, causing the abnormal driving of the panel.

Second, in switching between a signal mode and a no signal mode, the lock of the PLL in the EPI transfer unit of the timing controller is released, causing an abnormal operation.

In this case, as described above, the timing controller generates abnormal gate control signals (for example, GSP, GSC, and GOE, or VST and GCLK) to output the abnormal gate control signals to the gate driving IC, causing the abnormal output of the panel.

Third, an abnormal operation is caused even by the sudden change of an external environment such as static electricity, in which case the timing controller also generates the abnormal gate control signals (for example, GSP, GSC, and GOE, or VST and GCLK) to output the abnormal gate control signals to the gate driving IC, causing the abnormal output of the panel.

As described above, since the frequency of the timing signal DCLK transferred from the external system is changed and the timing signal DCLK is abnormally inputted to the LVDS reception unit, the related art LCD devices can perform an abnormal operation such as: that lock between the LVDS reception unit and the external system is released; that the lock of the EPI transfer unit is released by the switching of a mode or the like; or that lock between the data driving IC and the timing controller is released by an external environment or the like.

In this case, the timing controller can generate the abnormal gate control signals (for example, GSP, GSC, and GOE, or VST and GCLK) to output the abnormal gate control signals to the gate driving IC, in which case the abnormal display of the panel can be caused by the abnormal gate control signals. In the worst case, the panel itself can be damaged.

Moreover, when the above-described abnormal operations occur, the timing controller can generate an abnormal data control signal (for example, SOE, SSP, and/or SSC) to output the abnormal data control signal to the data driving IC, and generate an abnormal power control signal (for example, PWM and/or PLK) to output the abnormal power control signal to a power IC, causing the abnormal driving of an LCD device.

BRIEF SUMMARY

An LCD device includes: a driver including at least one gate driving IC for outputting a scan signal to a plurality of gate lines of a panel, and at least one data driving IC for respectively outputting a plurality of image data signals to a plurality of data lines of the panel; and a timing controller determining whether a current mode is an abnormal mode in which the panel outputs an abnormal image by using at least one lock signals, outputting a driver control signal generated for controlling the driver when the current mode is determined as a normal mode, and outputting a masking control signal, which makes the panel not to output the abnormal image, to the driver when the current mode is determined as the abnormal mode.

In another aspect of the present invention, there is provided a driving method of an LCD device including: generating a driver control signal which includes a gate control signal for controlling a gate driving IC and a data control signal for controlling a data driving IC, by using a timing signal inputted from an external system; realigning video data inputted from the external system; determining whether a current mode is an abnormal mode in which a panel outputs an abnormal image, by using at least one lock signal; and outputting the driving control signal to a driver when the current mode is determined as a normal mode, and outputting a masking control signal to the driver when the current mode is determined as the abnormal mode, the driver being driven according to the driver control signal, and the masking control signal making the panel not to output an abnormal image.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE DRAWINGS AND THE PRESENTLY PREFERRED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
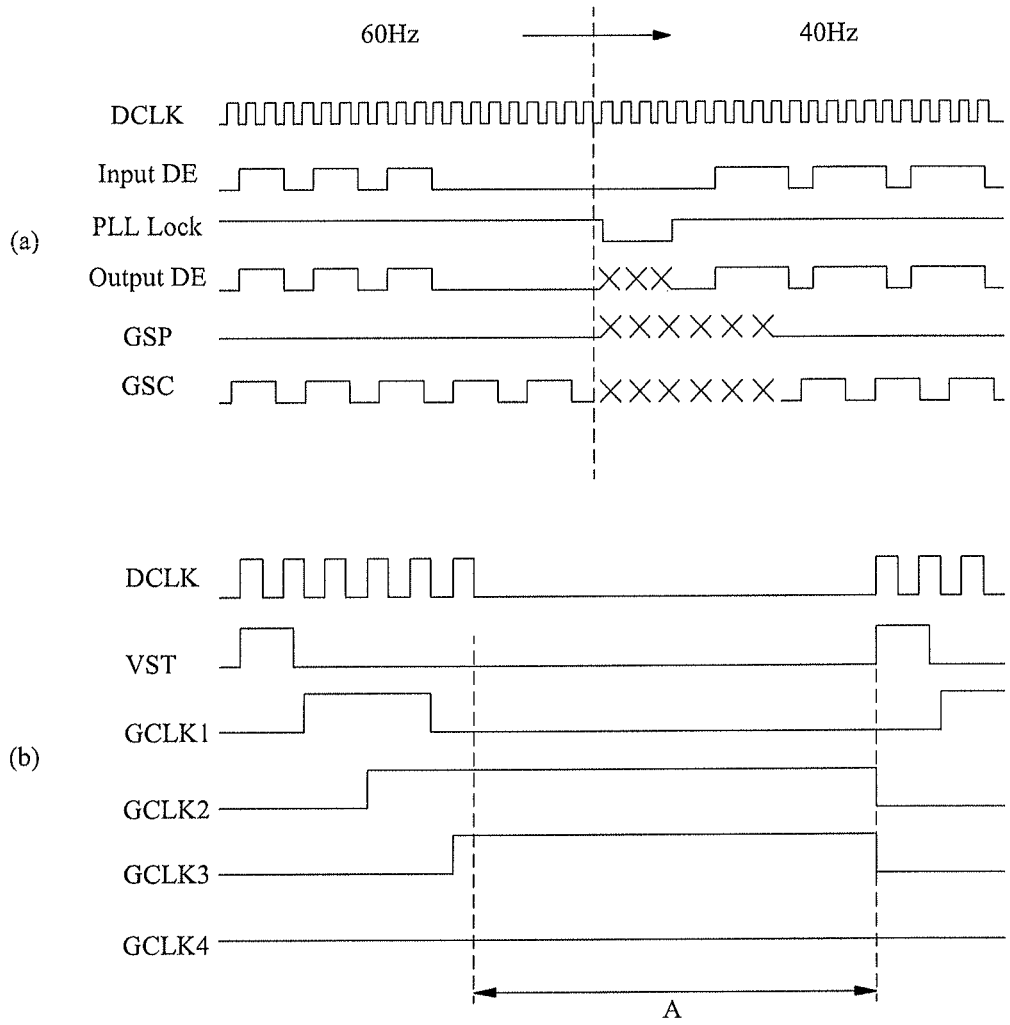
FIG. 1 is a timing diagram showing input signals and output signals of a related art timing controller.
Figure 2:
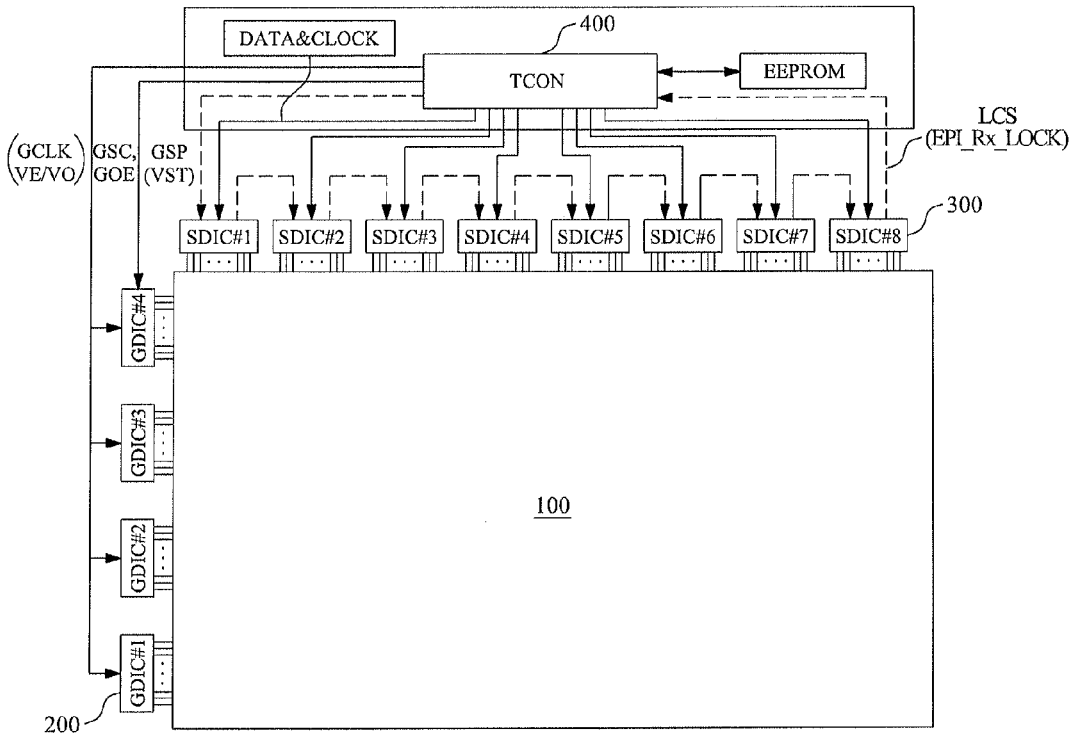
FIG. 2 is an exemplary diagram illustrating a configuration of an LCD device according to an embodiment of the present invention.
Figure 3:
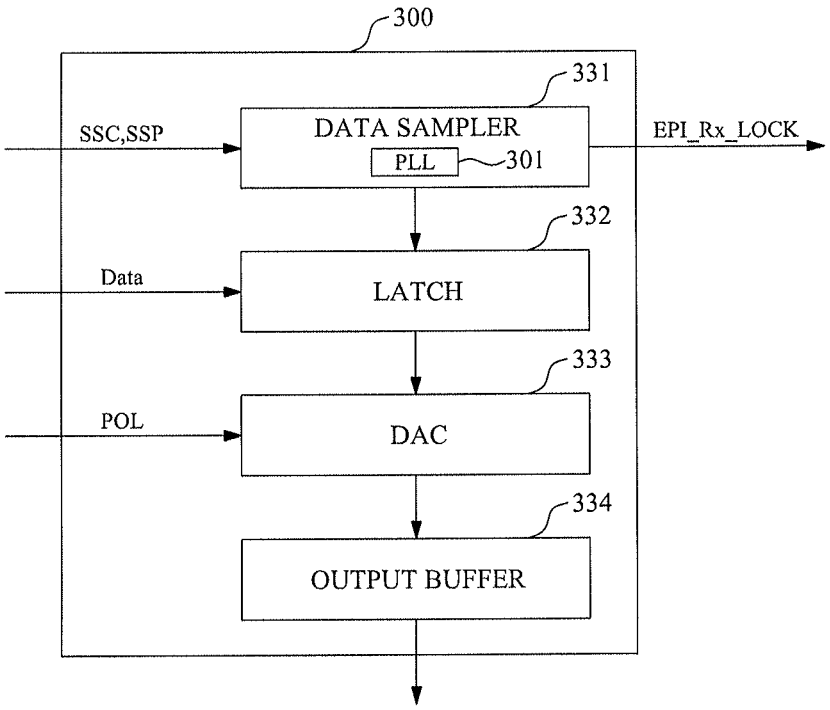
FIG. 3 is an exemplary diagram illustrating a configuration of a data driving IC in the LCD device according to an embodiment of the present invention.

FIG. 2 is an exemplary diagram illustrating a configuration of an LCD device according to an embodiment of the present invention. FIG. 3 is an exemplary diagram illustrating a configuration of a data driving IC in the LCD device according to an embodiment of the present invention.

The LCD device according to an embodiment of the present invention, as illustrated in FIG. 2, includes a panel 100 having a liquid crystal cell matrix, at least one gate driving ICs GDIC#1 to GDIC#4 for driving a plurality of gate lines of the panel 100, at least one data driving ICs SDIC#1 to SDIC#8 for driving a plurality of data lines of the panel 100, and a timing controller 400 for controlling the gate driving ICs 200 and the data driving ICs 300. Also, although not shown, the LCD device according to an embodiment of the preset invention may further include a backlight unit that emits light irradiated on the panel 100, and a power IC that controls a voltage applied to the backlight unit and the panel 100. In the following description, a collective name for the gate driving IC, the data driving IC, and the power IC is referred to as a driver, and a collective name for a gate control signal, a data control signal, and a power control signal that are generated by the timing controller 400 is referred to as a driver control signal.

The panel 100 includes a plurality of thin film transistors (TFTs) that are respectively formed in a plurality of areas which are defined by the intersection of a plurality of gate lines (GL1 to GLn) and data lines (DL1 to DLm), and a plurality of liquid crystal cells that includes a pixel electrode (PXL).

The thin film transistor (TFT) supplies a pixel signal (image data signal) to the pixel electrode (PXL) in response to a scan signal from the gate line. The pixel electrode (PXL) drives liquid crystal between a common electrode and the pixel electrode (PXL) in response to the pixel signal, thereby adjusting a light transmittance.

As a liquid crystal mode of the panel 100, a Twisted Nematic (TN) mode, a Vertical Alignment (VA) mode, an In-Plane Switching (IPS) mode, or a Fringe Field Switching (FFS) mode may be applied to the present invention. Also, the LCD device according to an embodiment of the present invention may be implemented as a transmissive LCD device, a semi-transmissive LCD device, or a reflective LCD device.

The timing controller 400 generates a gate control signal GCS for controlling an operation timing of each of the gate driving ICs 200 and a data control signal DCS for controlling an operation timing of each of the data driving ICs 300 by using a timing signal (for example, a dot clock DCLK used as a reference clock in the LCD device, a vertical sync signal Vsync, a horizontal sync signal Hsync, and a data enable signal DE) inputted from an external system, and respectively supplies image data signals to the data driving ICs 300.

A plurality of gate control signals GCS generated by the timing controller 400 may be changed according to the type of a gate driving IC. For example, as illustrated in FIG. 2, when the gate driving IC 200 is connected to the panel 100 in a Chip On Film (COF) type or a Tape Carrier Package (TCP) type, the gate control signals generated by the timing controller 400 may respectively be a gate start pulse GSP, a gate shift clock GSC, and a gate output enable signal GOE. Also, in a GIP type where the gate driving IC 200 is mounted on the panel 100, the gate control signals generated by the timing controller 400 may respectively be a gate start signal VST and a gate clock GCLK.

The data control signals generated by the timing controller 400 may respectively be a source start pulse SSP, a source shift clock signal SSC, a source output enable signal GOE, and a polarity control signal POL. However, the data control signals may be various changed according to an interface type (for example, a Transistor-Transistor Logic (TTL) type, a mini LVDS type, or an EPI type) which is used between the timing controller 400 and the data driving IC 300.

An interface between the timing controller 400 and the external system may use LVDS, and an interface between the timing controller 400 and the data driving IC 300 may use an EPI type.

Therefore, the timing controller 400 includes an LVDS reception unit for communicating with the external system by using LVDS, and includes an EPI transfer unit for communicating with the data driving IC 300 by using EPI. Each of the LVDS reception unit and the EPI transfer unit includes a PLL for locking the phase of an input/output signal. Also, the data driving IC 300 includes a PLL or a Delay Locked Loop (DLL) for locking the phase of an input/output signal. LVDS, EPI, and PLL will be described below.

The timing controller 400 determines whether a current mode is an abnormal mode where the gate control signal is abnormally outputted, by using a plurality of lock signals LVDS_Rx_LOCK, EPI_Tx_LOCK and EPI_Rx_LOCK that are respectively generated by the PLLs. When the current mode is determined as the abnormal mode, the timing controller 400 outputs a masking control signal MCS masked as a reference level to the driver, in addition to blocking the driver control signals that are respectively outputted to the gate driving IC 200, the data driving IC 300, and the power IC, and thus prevents the liquid crystal panel 100 from displaying an abnormal image.

The abnormal mode, as described above in the background, denotes a state where the driver control signal is not normally generated due to an abnormal operation such as: that lock of an LVDS reception unit 410 (see FIG. 4) is released because the frequency of the timing signal DCLK transferred from the external system is changed or the timing signal DCLK is abnormally inputted to the timing controller 400; that the lock of the EPI transfer unit is released by the switching of a mode or the like; or that lock of the data driving IC 300 is released by an external environment or the like.

A normal mode denotes a mode that is not the abnormal mode, and is a state where a normal lock signal is inputted to or outputted from the timing controller 400. In such a normal mode, the timing controller 400 may output the gate control signal (which has been generated with the timing signal) to the gate driving IC 200, output the data control signal to the data driving IC 300, and output the power control signal to the power IC.

Specifically, the timing controller 400 continuously monitors whether the abnormal mode occurs by using the lock signals LVDS_Rx_LOCK, EPI_Tx_LOCK and EPI_Rx_LOCK, and when a current mode is determined as the abnormal mode where the driver control signal is being outputted abnormally, the timing controller 400 outputs the masking control signal MCS to the driver such that an abnormal image is not displayed by the panel 100, in addition to blocking the output of a previously-generated abnormal driver control signal. Herein, for example, the masking control signal may be the gate control signal that makes a scan signal not to be outputted, for example, the gate start signal VST having a logic low level or the gate clock GCLK having a logic low level. In addition, the masking control signal MCS may be the data control signal that makes an abnormal image data signal not to be outputted to the data line, for example, the data output enable signal SOE having a logic high level or the power control signal (for example, PWM) for preventing the abnormal driving of the backlight unit. That is, the masking control signal may include any one of the gate control signal, data control signal, and power control signal that are respectively outputted to the gate driving IC 200, the data driving IC 300, and the power IC, for preventing that the gate driving IC 200, the data driving IC 300, or the power IC respectively drives the data line, the gate line, or the panel 100 and the backlight unit abnormally. A detailed description on this will be made below.

Each of the gate driving ICs GDIC#1 to GDIC#4 sequentially supplies the scan signal to the gate lines according to the gate control signals generated by the timing controller 400, in the normal mode. In response to the scan signal, the thin film transistors (TFTs) are driven in units of a horizontal line.

In the abnormal mode, the gate driving IC 200 is driven according to the masking control signal MCS generated by the timing controller 400, and thus does not supply the scan signal to the gate lines.

The gate driving IC 200 may apply the gate driving IC of the related art LCD device as-is. In the normal mode, the gate driving IC 200 is driven according to the gate control signal GCS transferred from the timing controller 400. However, in the abnormal mode, the gate driving IC 200 is driven according to the masking control signal MCS transferred from the timing controller 400.

Herein, as described above, the masking control signal MCS may be the gate control signal that makes the gate driving IC 200 not to output the scan signal. When the masking control signal MCS is received, the gate driving IC 200 does not output the scan signal to the gate line, and thus, when viewed from the outside, the gate driving IC 200 can be viewed as not being driven.

As described above, the gate driving IC 200 may be manufactured independently from the panel 100 and electrically connected to the panel 100 in various types, but the present invention is not limited thereto. As another example, the gate driving IC 200 may be provided in the GIP type where the gate driving IC 200 is mounted into the liquid crystal panel 100.

In this case, the gate start signal VST and the gate clock GCLK may be used as control signals for controlling the gate driving IC 200. Therefore, a gate driving IC using the GIP type will be described below as an example.

However, the present invention is not limited thereto, and thus, the gate driving IC may be implemented in a type other than the GIP type, in which case various signals GSP, GSC and GOE, which make the gate driving IC not to output the scan signal or to be abnormally driven, may be applied as the gate control signals.

The data driving IC 300 converts input image data into analog pixel signals (image data signals) and respectively supplies the image data signals for one horizontal line to the data lines at every one horizontal period where the scan signal is supplied to one gate line. That is, the data driving IC 300 converts image data into image data signals by using gamma voltages supplied from the gamma voltage generator (not shown), and respectively outputs the image data signals to the data lines.

In the abnormal mode, similarly to the gate driving IC 200, the data driving IC 300 may receive the masking control signal MCS (for example, SOE, POL, etc.) that makes the image data signal not to be outputted to the data line, and thus may not output the image data signal.

However, in the abnormal mode, since the scan signal is not outputted to the gate line due to the masking control signal MCS outputted from the gate driving IC 200, a separate masking control signal for disallowing the output of the image data signal may not be outputted from the timing controller 400.

Even if each of the data driving ICs SDIC#1 to SDIC#8 performs the operation of the normal mode even in the abnormal mode, the scan signal is not supplied to the gate line by the gate driving IC because the gate driving IC 300 is driven according to the masking control signal MCS transferred from the timing controller 400, in the abnormal mode. Accordingly, in the abnormal mode, even when an image data signal is outputted to a data line by the data driving IC 300, an abnormal image is not displayed by the panel 100 because the image data signal is not charged into a pixel.

Moreover, as described above, in the abnormal mode, even if an image data signal is outputted from the data driving IC 300 to a data line, since the data driving IC 300 itself and the liquid crystal panel 100 are not greatly damaged, the timing controller 400 does not generate the masking control signal MCS for disallowing the output of the image data signal.

Therefore, the data driving IC 300 may apply the data driving IC of the related art LCD device using the EPI type as-is. In the normal mode, the data driving IC 300 stores digital image data, transferred from the timing controller 400, as analog image data signals and then respectively outputs the image data signals to the data lines during one horizontal period when the scan signal is sequentially applied to the gate line by the gate driving IC 200 that is driven according to the gate control signal transferred from the timing controller 400.

The data driving IC 300, as disclosed in Patent Application Number KR10-2008-0127456 and illustrated in FIG. 3, includes a data sampler 331, a latch 332, a digital-to-analog converter (DAC) 333, and an output buffer 334. Particularly, the data sampler 331 includes a PLL 301.

The data sampler 331 analyzes an input signal and a output signal. When both the input signal and the output signal are identical, the data sampler 331 outputs a logic high level of lock signal (Lock Out). The logic high level of lock signal is transferred to data driving ICs SDIC#2 to SDIC#8 of a next stage, and a last data driving IC SDIC#8 feeds back a logic high level of lock signal EPI_Rx_LOCK to an EPI transfer unit 440 and control signal generation unit 420 of the timing controller 400 (see FIG. 4).

Accordingly, when the logic high level of lock signal EPI_Rx_LOCK is not received from the last data driving IC SDIC#8, the control signal generation unit may determine a current mode as the abnormal mode where the mismatch of a driving frequency occurs between the timing controller 400 and the data driving ICs 300 and, as described above, output the masking control signal.

Hereinafter, the detailed configuration and function of the timing controller 400 will be described with reference to FIGS. 4 to 6.

Figure 4:
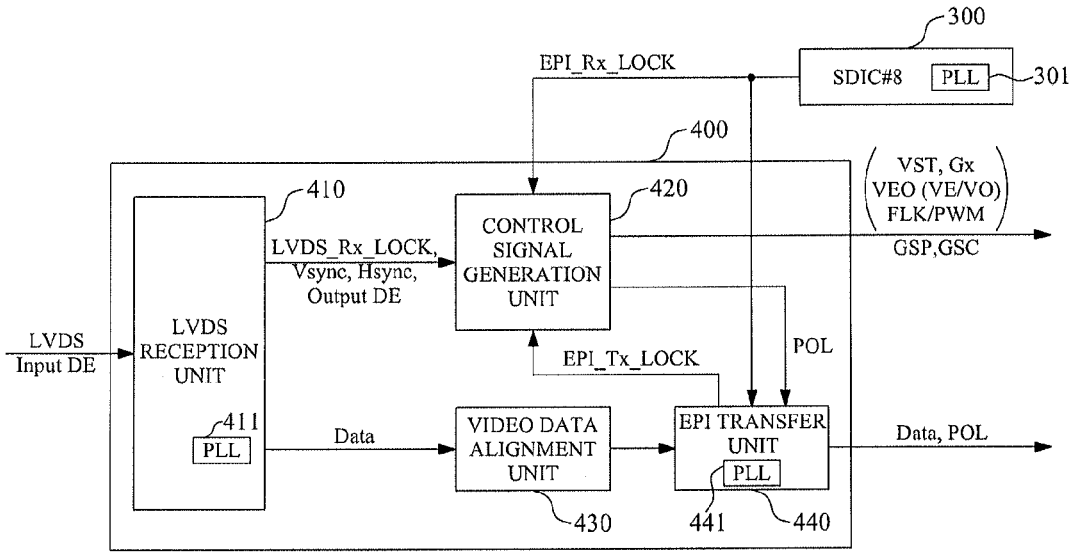
FIG. 4 is an exemplary diagram illustrating a configuration of a timing controller in the LCD device according to an embodiment of the present invention.

FIG. 4 is an exemplary diagram illustrating a configuration of the timing controller 400 in the LCD device according to an embodiment of the present invention. FIG. 5 is an exemplary diagram illustrating an internal configuration of the control signal generation unit 420 in the timing controller of FIG. 4. FIG. 6 is an exemplary diagram showing waveforms of control signals which are inputted to or outputted from an abnormal mode determination unit 423 of FIG. 5.

The timing controller 400 generates and outputs the gate control signal GCS for controlling the gate driving ICs 200 and the data control signal DCS for controlling the data driving ICs 300, or the power control signal for controlling the power IC, by using the vertical sync signal Vsync, the horizontal sync signal Hsync, and the dot clock DCLK that are supplied from the external system.

The timing controller 400 is monitoring whether a current mode is the abnormal mode or the normal mode by using the lock signals generated by the PLLs, and then, when the current mode is determined as the abnormal mode where the driver control signal is being outputted abnormally, the timing controller 400 blocks the output of the gate start signal VST and gate clock signal GCLK that are the gate control signals transferred to the driver (particularly, the gate driving IC 200) and outputs the masking control signal MCS having a predetermined reference level to the gate driving IC 200. That is, in the abnormal mode, as described above, the masking control signal MCS for controlling the driver may include the gate control signal, the data control signal, and the power control signal, but particularly, a gate control signal that disallows the output of the scan signal may be used as an efficient masking control signal.

When the masking control signal is the gate control signal, the predetermined reference level may be the level of the gate start signal VST or gate clock signal GCLK that disallows the abnormal driving of the gate driving IC 200 or makes the gate driving IC 200 not to output the scan signal. Therefore, in a gate driving IC that is driven by an N-type transistor, the gate start signal VST and gate clock signal GCLK corresponding to the masking control signal MCS may have a logic low level.

In the abnormal mode, when the gate start signal VST and gate clock signal GCLK having a logic low level (L(0)) are inputted as the masking control signal MCS to the gate driving IC 200, the gate driving IC 200 does not output the scan signal to the gate line of the panel 100. Accordingly, in the abnormal mode, even when an image data signal is outputted from the data driving IC 300, an abnormal image is not outputted because the image data signal cannot be charged into a pixel.

For this end, as illustrated in FIG. 4, the timing controller 400 may include: the LVDS reception unit 410 that receives video data "Data" and the timing signal (for example, Vsync, Hsync, DE, and DCLK) from the external system; a video data alignment unit 430 that realigns the video data "Data" to output image data; the control signal generation unit 420 that: determines whether a current mode is the abnormal mode or the normal mode by using the lock signals; generates and outputs the gate control signal GCS for controlling the gate driving IC 200, the data control signal DCS for controlling the data driving IC 300, and the power control signal PWM for controlling the power IC by using the timing signal when the current mode is determined as the normal mode; and generates and outputs the masking control signal MCS (which is generated by masking the driver control signal as the reference level), in addition to blocking the output of the driver control signal (for example, the gate control signal, the data control signal, and the power control signal) when the current mode is determined as the abnormal mode; and the EPI transfer unit 440 that respectively outputs the data control signal DCS transferred to the control signal generation unit 420 and the image data transferred from the video data alignment unit 430, to the data driving ICs 300 in a point-to-point scheme. Also, although not shown, the timing controller 400 may further include an internal clock generation unit (VCO) that generates an internal clock which is internally required by the timing controller 400, a storage unit (SRAM) that stores various information, and an I2C master that communicates with the storage unit and other sub-ICs.

The LVDS reception unit 410 receives the timing signal (including the vertical sync signal Vsync, the horizontal sync signal Hsync, the dot clock DCLK, and the data enable DE) and video data RGB from the external system (not shown), for example, may be configured with an LVDS interface.

Herein, the LVDS interface is a high-speed digital interface. The LVDS interface generates two signals having opposite polarities and transfers data on the basis of the two signals. Therefore, the LVDS interface transfers data at a low voltage, and thus has low power consumption, a high transfer speed, and an excellent tolerance to noise.

Such an LVDS reception unit 410 is connected to an LVDS transmitter (not shown) of the external system, and includes a PLL 411 internally.

The PLL 411 maintains the constant frequency (phase) of an input signal (including video data and a timing signal) transferred from the external system and the constant frequency (phase) of an output signal outputted from the LVDS reception unit 410. When the constant frequency (phase) of the input signal and the constant frequency (phase) of the output signal are maintained, the PLL 411 outputs an LVDS reception lock signal LVDS_Rx_LOCK having a logic high level (H) (hereinafter referred to as a first lock signal LVDS_Rx_LOCK).

The first lock signal LVDS_Rx_LOCK continuously maintaining a logic high level (H(1)) denotes that a clock used in the external system and the LVDS reception unit 410 is locked at a constant frequency, but the first lock signal LVDS_Rx_LOCK being changed from a logic high level (H(1)) to a logic low level (L(0)) denotes that the lock between the external system and the LVDS reception unit 410 is released.

In this way, when the lock between the external system and the LVDS reception unit 410 is released, as described above, a current mode is changed to the abnormal mode, and thus, the timing controller 400 generates the abnormal gate control signals.

The video data alignment unit 430 realigns digital video data RGB, which have been received by the LVDS reception unit 410 from the external system and changed to a TTL type, to be suitable for the resolution of the liquid crystal panel 100 and thus outputs realigned image data.

The EPI transfer unit 440 transfers the data control signal DCS transferred from the control signal generation unit 420 and the image data transferred from the video data alignment unit 430, to the data driving IC 300. The EPI transfer unit 440, as disclosed in Patent Application Number KR10-2008-0127456, connects the timing controller 400 to the data driving ICs SDIC#1 to SDIC#8 in the point-to-point type and is generally used in a timing controller that interfaces the data driving IC 300 in the EPI type.

A summary on a configuration between the EPI transfer unit 400 and the data driving ICs 300 will be provided below.

A plurality of lines such as a plurality of date line pairs DATA&CLK, a pair of control lines SCL/SDA, and a lock check line LCS are connected between the EPI transfer unit 440 and each of the data driving ICs SDIC#1 to SDIC#8.

The data line pairs DATA&CLK serially connect the EPI transfer unit 440 to each of the data driving ICs SDIC#1 to SDIC#8 in a relationship of 1:1, namely, the point-to-point type. Each of the data driving ICs (SDIC#1 to SDIC#8) 300 restores clocks that are inputted through the data line pairs DATA&CLK, and thus, as illustrated in FIG. 2, lines for transferring image data are not required between adjacent data driving ICs of the data driving ICs SDIC#1 to SDIC#8.

The lock check line LCS, as described above, transfers a lock signal between the EPI transfer unit 440 and the data driving IC 300 and between the data driving ICs 300. A third lock signal EPI_Rx_LOCK is transferred from the last data driving IC 300 to the control signal generation unit 420 of the timing controller 400. Therefore, the control signal generation unit 420 may determine whether a current mode is the abnormal mode by using the third lock signal EPI_Rx_LOCK.

The EPI transfer unit 440 respectively transfers a chip identification code of each of the data driving ICs SDIC#1 to SDIC#8 and a plurality of chip each control data for controlling the respective functions of the data driving ICs SDIC#1 to SDIC#8, to the data driving ICs SDIC#1 to SDIC#8 through the pair of control lines SCL/SDA.

A summary on the function of the EPI transfer unit 440 will be provided below.

Before transferring image data to the data driving IC 300, the EPI transfer unit 440 supplies a lock signal LOCK for checking whether clock division by the data driving ICs SDIC#1 to SDIC#8 and the output of the data sampler are steadily locked, to a first data driving IC SDIC#1 through a lock check line LCS1.

When the frequency and phase of an output clock for sampling data are locked, the first data driving IC SDIC#1 transfers a lock signal having a logic high level (H(1)) to a second data driving IC SDIC#2, which locks the frequency and phase of the output clock and then transfers a logic high level of lock signal to a third data driving IC SDIC#3.

In this way, when the frequency and phase of the output clock of each of the data driving ICs SDIC#1 to SDIC#7 are sequentially locked and then the frequency and phase of the output clock of the last driving IC SDIC#8 are locked, the last data driving IC SDIC#8 feeds back a logic high level of third lock signal EPI_Rx_LOCK to the EPI transfer unit 440 and the control signal generation unit 420 through a feedback lock check line LCS.

The EPI transfer unit 440 receives the feedback of the third lock signal, and then transfers a data control signal packet and an image data packet to each of the data driving ICs SDIC#1 to SDIC#8.

The EPI transfer unit 440 transfers the data control signal and the image data to each data driving IC 300.

As in the LVDS reception unit 410 or the data driving IC 300, the EPI transfer unit 440 having the above-described function also includes a PLL 441.

The PLL 441 included in the EPI transfer unit 440 maintains the constant frequency (phase) of an input signal transferred from the video data alignment unit 430 or the control signal generation unit 420 and the constant frequency (phase) of an output signal outputted from the EPI transfer unit 440. When the constant frequency (phase) of the input signal and the constant frequency (phase) of the output signal are maintained, the PLL 441 outputs a lock signal having a logic high level (H) (hereinafter referred to as a second lock signal EPI_Tx_LOCK).

The second lock signal EPI_Tx_LOCK continuously maintaining a logic high level (H(1)) denotes that a clock used in the video data alignment unit 430 or the control signal generation unit 420 and the EPI transfer unit 440 is locked at a constant frequency, but the second lock signal EPI_Tx_LOCK being changed from a logic high level (H(1)) to a logic low level (L(0)) denotes that the lock between the video data alignment unit 430 or the control signal generation unit 420 and the EPI transfer unit 440 is released.

In this way, when the lock between the video data alignment unit 430 or the control signal generation unit 420 and the EPI transfer unit 440 is released, as described above, a current mode is changed to the abnormal mode, and thus, the timing controller 400 generates the abnormal gate control signals or the panel 100 displays an abnormal image.

Figure 5:
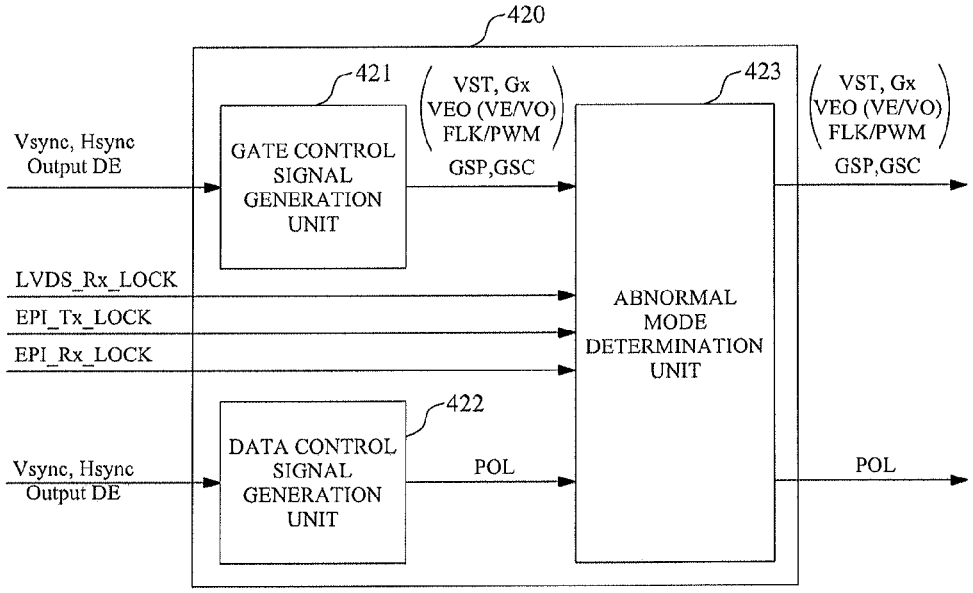
FIG. 5 is an exemplary diagram illustrating an internal configuration of a control signal generation unit in the timing controller of FIG. 4.

The control signal generation unit 420, as illustrated in FIG. 5, may include a gate control signal generation unit 421, a data control signal generation unit 422, and an abnormal mode determination unit 423.

The control signal generation unit 420 receives the timing signal (including the vertical sync signal Vsync, the horizontal sync signal Hsync, the data enable signal DE, and the dot clock DCLK) from the LVDS reception unit 410 to generate the data control signal DCS for controlling the operation timing of the data driving IC 300, the gate control signal GCS for controlling the operation timing of the gate driving IC 200, and the power control signal for controlling the operation timing of the power IC.

The control signal generation unit 420 determines whether the LCD device is in the abnormal mode by using the first lock signal LVDS_Rx_LOCK received from the LVDS reception unit 410, the second lock signal EPI_TX_LOCK received from the EPI transfer unit 440, and the third lock signal EPI_RX_LOCK received from the last data driving IC SDIC#8.

When the determined result shows that the LCD device is in the normal mode, the control signal generation unit 420 generates the driver control signal to output the gate control signal to the gate driving IC 200 and output the data control signal DCS to the EPI transfer unit 440.

Figure 6:
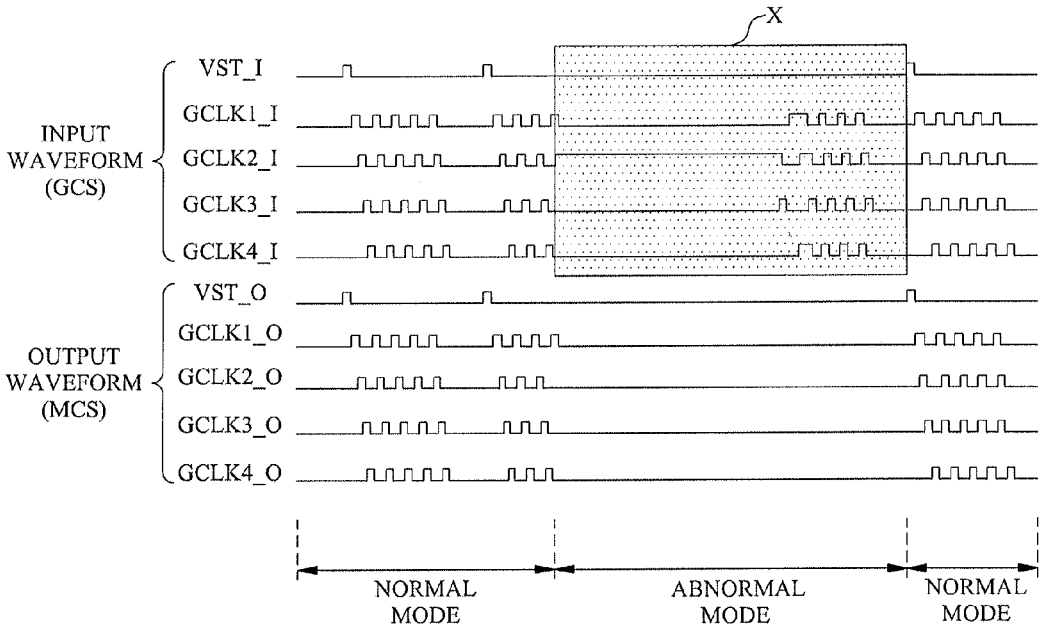
FIG. 6 is an exemplary diagram showing waveforms of control signals which are inputted to or outputted from an abnormal mode determination unit of FIG. 5.

When the determined result shows that the LCD device is in the abnormal mode, as shown in FIG. 6, the control signal generation unit 420 generates the masking control signal MCS that makes the gate driving IC 200 not to output the scan signal to the gate line and outputs the masking control signal MCS to the gate driving IC 200, in addition to blocking the output of the gate control signals generated by the gate control signal generation unit 421. Also, when the LCD device is in the abnormal mode as the determined result, the control signal generation unit 420 may generate the masking control signal that includes the data control signal or power control signal for making the panel 100 not to output an abnormal image, and output the masking control signal to the data driving IC 300 or the power IC.

FIG. 6 shows waveforms of signals that are inputted to or outputted from the abnormal mode determination unit 423 of the control signal generation unit 420. The input signal inputted to the abnormal mode determination unit 423 may be the gate control signal GCS generated by the gate control signal generation unit 421. The gate control signal GCS, as described above, may include the gate start pulse GSP, gate source clock GSC, and gate output enable signal GOE, or the gate start signal VST and gate clock GCLK according to the configuration type of the gate driving IC 200. However, since the present invention applies the GIP type as an example, FIG. 6 shows waveforms of the gate control signals GCS applied to the GIP type.

In addition to the gate control signals GCS, signals that are inputted to or outputted from the abnormal mode determination unit 423 may include the data control signal DCS generated by the data control signal generation unit 422 and the signals VEO and PWM for controlling the power ICs.

Whether a current mode is the abnormal mode is determined by the abnormal mode determination unit 423 of the control signal generation unit 420, the abnormal mode determination unit 423 determines the abnormal mode or the normal mode according to the below-described method.

When the current mode is determined as the normal mode, the abnormal mode determination unit 423 transfers the gate control signal GCS (which is generated by the gate control signal generation unit 421 and inputted to the abnormal mode determination unit 423) and the other driver control signals inputted thereto to the gate driving IC 20 and the other elements (the data driving IC 300, the power IC, etc.), respectively.

When the current mode is determined as the abnormal mode, as shown in FIG. 6, abnormal gate control signals X are included in the gate control signal that is generated by the gate control signal generation unit 421 and inputted to the abnormal mode determination unit 423 in the determined abnormal mode.

Therefore, the abnormal mode determination unit 423 blocks the output of the abnormal gate control signal X and outputs the masking control signal MCS (output signal), which disallows the output of the scan signal, to the gate driving IC 200.

In a GIP type of gate driving IC that are configured with a plurality of N-type transistors, when the gate start signal VST and gate clock GCLK have a logic low level (L(0)), the gate driving IC does not output the scan signal to the gate line. Accordingly, during an abnormal mode period, the abnormal mode determination unit 423 outputs the masking control signal MCS which is generated by setting gate control signals VST, GCLK1_0, GCLK2_0, GCLK3_0 and GCLK4_0 outputted to the gate driving IC to a logic low level.

To provide an additional description, the masking control signal MCS may be the gate control signal outputted to the gate driving IC 200, in which case the level of the masking control signal MCS may be set as a logic low level that disallows the output of the scan signal.

The masking control signal MCS may include various gate control signals that make the scan signal not to be outputted to the gate line, and may be a data control signal that makes image data not to be outputted to the data line. Also, the masking control signal MCS may include power control signals (for example, PWM, VEO, etc.) for disallowing the driving of various power ICs.

The following description will be made in detail with reference to FIGS. 7 and 8 on the detailed configuration and function of the abnormal mode determination unit 423 that determines whether the LCD device is in the abnormal mode and outputs various driver control signals including the gate control signal GCS or the masking control signal MCS according to the determined result.

Figure 7:
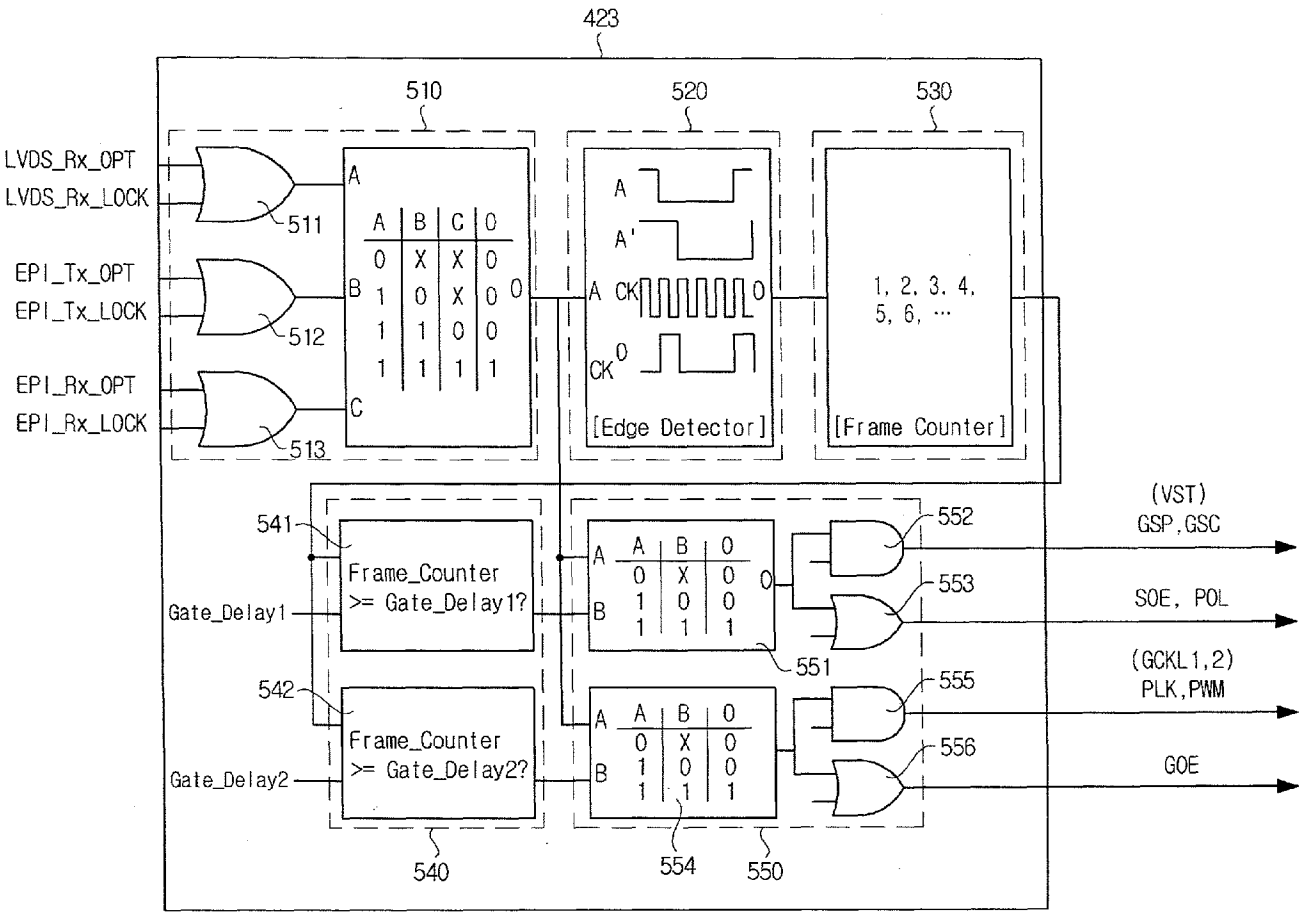
FIG. 7 is an exemplary diagram illustrating an internal configuration of the abnormal mode determination unit of FIG. 5.

FIG. 7 is an exemplary diagram illustrating an internal configuration of the abnormal mode determination unit 423 of FIG. 5. FIG. 8 is an exemplary diagram showing simulation results of various signals which are inputted to or outputted from the abnormal mode determination unit 423 of FIG. 5.

Referring to FIG. 7, the abnormal mode determination unit 423 includes an option processing unit 510, a frame counter initialization unit 520, a frame counter 530, a masking determination information generation unit 540, and a masking control signal output unit 550.

The option processing unit 510 processes whether to determine the abnormal mode by using any one of the three lock signals LVDS_Rx_LOCK, EPI_Tx_LOCK and EPI_Rx_LOCK.

For this end, the option processing unit 510 includes three OR gates 511 to 513. The lock signal LVDS_Rx_LOCK and an option LVDS_Rx_OPT, which includes information regarding whether to use the lock signal LVDS_Rx_LOCK, are respectively inputted to two input ports of the OR gate 511. The lock signal EPI_Tx_LOCK and an option EPI_

Tx_OPT, which includes information regarding whether to use the lock signal EPI_Tx_LOCK, are respectively inputted to two input ports of the OR gate 512. The lock signal EPI_Rx_LOCK and an option EPI_Rx_OPT, which includes information regarding whether to use the lock signal EPI_Rx_LOCK, are respectively inputted to two input ports of the OR gate 513.

The respective options, which include the information regarding whether to use the lock signals, are set by a manufacturer of the LCD device and stored in an Erasable Programmable Read-Only Memory (EEPROM) (see FIG. 2). When the timing controller 400 is turned on, the options are inputted to the abnormal mode determination unit 423.

For example, when the first lock signal LVDS_Rx_LOCK is set to be used for determining whether a current mode is the abnormal mode, the first option LVDS_Rx_OPT may be set to have a logic low level (L(0)). Therefore, an output A of the first OR gate 511 receiving the first lock signal LVDS_Rx_LOCK and the first option LVDS_Rx_OPT is determined according to the logic level of the first lock signal LVDS_Rx_LOCK.

When the second lock signal EPI_Tx_LOCK is set to be used for determining whether a current mode is the abnormal mode, the second option EPI_Tx_OPT may be set to have a logic high level (H(1)). Therefore, an output B of the second OR gate 512 receiving the second lock signal EPI_Tx_LOCK and the second option EPI_Tx_OPT has a logic high level (H(1)) always.

When the three lock signals are all set to be used for determining whether a current mode is the abnormal mode, the following Table 1 lists respective output values A to C of the OR gates 511 to 513 in the option processing unit 510, and first information "0" outputted from the option processing unit 510. Table 1 is a table that is shown in the option processing unit 510 of FIG. 7.

TABLE 1

| A(511) | B(512) | C(513) | 0 |
|---|---|---|---|
| 0 | x | x | 0 |
| 1 | 0 | x | 0 |
| 1 | 1 | 0 | 0 |
| 1 | 1 | 1 | 1 |

As shown in Table 1, the output signal of the first OR gate 511 having a logic low level (L(0)) denotes that the first lock signal LVDS_Rx_LOCK has a logic low level (L(0)) when the first option LVDS_Rx_OPT has a logic low level (L(0)) (this is because the first lock signal is set to be used for determining whether a current mode is the abnormal mode). The first lock signal LVDS_Rx_LOCK having a logic low level (L(0)) denotes that the lock between the external system and the LVDS reception unit 410 of the timing controller 400 is released because the frequency of a clock used in the external system is not matched with the frequency of a clock used in the LVDS reception unit 410, in which case the timing controller 400 cannot output a normal gate control signal. Accordingly, the output signal of the option processing unit 510 has a logic low level (L(0)).

In Table 1, the output signal of the first OR gate 511 having a logic high level (H(1)) denotes that the first option LVDS_Rx_OPT is set to a logic high level (H(1)) so as not to be used for determining whether a current mode is the abnormal mode, or that the first lock signal LVDS_Rx_LOCK has a logic high level (H(1)) when the first option LVDS_Rx_OPT has been set to be used for determining whether a current mode is the abnormal mode (i.e., L). Therefore, the abnormal mode cannot be determined using only the output signal A of the first OR gate 511. The output signal B of the second OR gate 512 having a logic low level (L(0)) denotes that the lock between the EPI transfer unit 440 and the other elements is released inside the timing controller 400, in which case the timing controller 400 cannot output a normal gate control signal. Accordingly, the output signal of the option processing unit 510 has a logic low level (L(0)).

In Table 1, according to the above description, the output signal A of the first OR gate 511 and the output signal B of the second OR gate 512 having a logic high level (H(1)) and the output signal C of the third OR gate 513 having a logic low level (L(0)) denote that the lock between the EPI transfer unit 440 and the data driving IC 300 is released. Accordingly, the first information that is the output signal of the option processing unit 510 has a logic low level (L(0)).

In Table 1, however, the respective output signals A to C of the first to third OR gates 511 to 513 having a logic high level (H(1)) denotes that the three lock signals are all locked, or all lock signals which are used to determine whether a current mode is the abnormal mode are locked. This denotes that the LCD device operates in the normal mode. Thus, the first information that is the output signal of the option processing unit 510 has a logic high level (H(1)).

That is, the option processing unit 510 performs a logical AND operation on the output signals of the three OR gates by using an AND gate (not shown).

The frame counter initialization unit 520 receives a clock CK and the first information A that is the output signal of the option processing unit 510. Also, by using the clock CK, the frame counter initialization unit 520 detects the rising edge or falling edge of the first information A that is the output signal of the option processing unit 510 and initializes the frame counter 530.

The first information A, which is outputted from the option processing unit 510 and inputted to the frame counter initialization unit 520, includes information regarding whether the LCD device is in the abnormal mode or the normal mode, as described above. Therefore, the first information A being changed from a logic high level to a logic low level or from a logic low level to a logic high level denotes that the lock signal is changed from an abnormal state to a normal state or from the normal state to the abnormal state. By using the dot clock DCLK or an internal clock that is generated by the internal clock generation unit (VCO) of the timing controller 400, the frame counter initialization unit 520 detects the falling edge and rising edge of the first information A and then transfers the detected information to the frame counter 530 to initialize the frame counter 530.

For example, the frame counter initialization unit 520 detects the falling edge and rising edge of the first information A inputted from the option processing unit 510 and the falling edge and rising edge of a delay signal A' that is generated by delaying the first information by a predetermined clock. As illustrated in the frame counter initialization unit 520 of FIG. 7, when a falling edge occurs in each of the first information A and the delay signal A', this denotes that the lock signal is changed from a normal state to an abnormal state. Accordingly, the frame counter initialization unit 520 detects two falling edges to generate a detection clock O.

When a rising edge occurs in each of the first information A and the delay signal A', this denotes that the lock signal is changed from an abnormal state to a normal state. Accordingly, the frame counter initialization unit 520 detects two rising edges to generate the detection clock O.

The falling edge or the rising edge occurring due to the change in the two signals A and A' denotes that at least one of the three lock signals is changed from an abnormal state to a normal state or from the normal state to the abnormal state. Therefore, the frame counter initialization unit 520 generates the detection clock O (see the frame counter initialization unit 520 in FIG. 7) by using the detected information and outputs the detection clock O to the frame counter 530.

The frame counter 530 starts to count the number of frames according to the detection clock that is generated and transferred by the frame counter initialization unit 520 as described above. Herein, the number of frames is counted in the order of 0, 1, 2, and 3.

For example, when the option processing unit 510 uses the third lock signal EPI_Rx_LOCK for determining whether a current mode is the abnormal mode, the third lock signal EPI_Rx_LOCK is outputted from the option processing unit 510. The third lock signal EPI_Rx_LOCK outputted from the option processing unit 510 becomes the first information and thus is inputted as the input value of the frame counter initialization unit 520.

As illustrated in FIG. 7, when the third lock signal EPI_Rx_LOCK has a logic high level (H(1)), the LCD device is in the normal mode, and a rising edge or a falling edge is not detected by the frame counter initialization unit 520. Therefore, the frame counter 530 does not count the number of frames but normally outputs gate control signals VST, GCLK1 and GCLK2, generated by the gate control signal generation unit 421, to the gate driving IC 200 and also outputs the other driver control signals to corresponding drivers.

However, when the third lock signal EPI_Rx_LOCK is changed from a logic high level (H(1)) to a logic low level (L(0)), a falling edge Y is detected from each of the first information A and delay signal A' of the frame counter initialization unit 520. This denotes that at least one lock signal is changed from a normal state to an abnormal state. Accordingly, the frame counter initialization unit 520 generates the detection clock and transfers the detection clock to the frame counter 530, whereupon the frame counter 530 starts to counter the number of frames.

When the third lock signal EPI_Rx_LOCK is changed from a logic low level (L(0)) to a logic high level (H(1)), a rising edge Z is detected from each of the first information A and delay signal A' of the frame counter initialization unit 520. This denotes that all lock signals applied to the determination of the abnormal mode are changed from an abnormal state to a normal state. Accordingly, the frame counter initialization unit 520 generates the detection clock and transfers the detection clock to the frame counter 530, whereupon the frame counter 530 restarts to counter the number of frames.

The frame counter 530 is initialized by the detection clock transferred from the frame counter initialization unit 520, and counts the number of frames.

The maximum number of frames countable by the frame counter 530 may be set by the manufacturer and stored. Therefore, the necessary counting of many frames is not required after the normal mode is determined. Also, when a certain number (or more) of frames are counted even in the abnormal mode, this denotes that a serious problem has occurred in the driving of the LCD device and thus may be considered as a state that cannot be solved by the driving method of the present invention.

Therefore, the manufacturer may set the limitation of the abnormal mode solvable by the present invention as the maximum number of countable frames and store the maximum number of countable frames in the EEPROM. Such information may be transferred to the timing controller 400 upon the turn-on of the timing controller 400.

In an embodiment of the present invention, as illustrated in FIG. 7, the maximum number of countable frames is set as 7.

The masking determination information generation unit 540 compares the number of gate delays (which has been previously set by the manufacturer) with the number of frames that has been counted by the frame counter 530, and thus generates second information necessary for determining whether to mask the driver control signal as the masking control signal.

For this end, the masking determination information generation unit 540 determines whether the number of frames counted by the frame counter 530 is greater than or equal to the number of gate delays.

A method, which generates the masking control signal through the determination, will be described below together with the description of the masking control signal output unit 550.

In FIG. 7, the masking determination information generation unit 540 is illustrated as including two generators 541 and 542. This is for generating a plurality of driver control signals corresponding to the masking control signal MCS, particularly, for separately generating the driver control signals to which the different numbers of gate delays are respectively applied.

Figure 8:
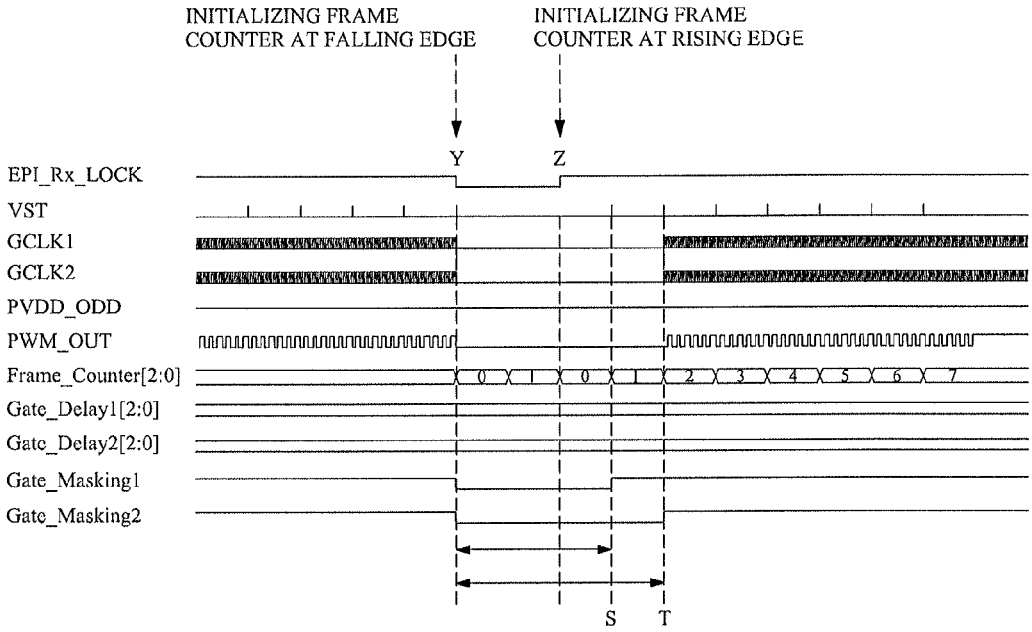
FIG. 8 is an exemplary diagram showing simulation results of various signals which are inputted to or outputted from the abnormal mode determination unit of FIG. 5.

For example, as illustrated in FIGS. 7 and 8, the number of gate delays applied to the generation of the masking control signal such as the gate start signal VST or the gate start pulse GSP and the gate source clock GSC is 1 (Gate_Delay1), and the number of gate delays applied to the generation of the masking control signal such as the signals GCLK, FLK and PWM is 2 (Gate_Delay2). That is, since the different numbers of gate delays are applied, the masking determination information generation unit 540 of FIG. 7 separately includes the two generators 541 and 542 using the different numbers of gate delays.

Therefore, even if a plurality of masking control signals are generated, when the number of gate delays is the same, the masking determination information generation unit 540 may be configured with only one generator.

Except that different masking control signals are generated by applying the different numbers of gate delays as described above, the two generators 541 and 542 of FIG. 7 have the same function and configuration. Thus, the following description will be made on an example where the masking determination information generation unit 540 is configured with the first generator 541 for outputting the gate start signal VST.

The masking control signal output unit 550 outputs the masking control signal or the driver control signal that is generated by the gate control signal generation unit 421 or the data control signal generation 422, by using the second information B transferred from the masking determination information generation unit 540 or the first information A transferred from the option processing unit 510.

For this end, the masking control signal output unit 550 includes a determining unit 551 that receives the first and second information A and S as input signals, and an outputting unit 552 that outputs the driver control signal or the masking control signal by using an output signal of the determining unit 551.

Herein, when the number of counted frames is greater than or equal to the number of gate delays, the second information has a logic high level (H(1)), but when the number of counted frames is less than the number of gate delays, the second information has a logic low level (L(0)).

The first information A, as described above, has a logic high level (H(1)) when all lock signals applied to the determination of the abnormal mode are in a normal state, or when at least one lock signal is in an abnormal state, the first information A has a logic low level (L(0)).

As shown in FIG. 8, when a falling edge point Y occurs where the third lock signal EPI_Rx_LOCK falls from a logic high level to a logic low level, the frame counter 530 starts to count the number of frames. Since then, because the LDC device is in the abnormal mode, the third lock signal EPI_Rx_LOCK has a logic low level (L(0)).

At this point, the masking determination information generation unit 540 determines whether the number of counted frames is greater than or equal to the predetermined number of gate delays (Gate Delay1).

First, as an example, when the failing edge point Y of the third lock signal occurs (see FIG. 8) and thus the number of frames is counted, the initial number of counted frames is 0, the number of gate delays is set as 1 as described above, and thus, the number of counted frames "0" is less than the number of gate delays "1", whereupon the first generator 541 of the masking determination information generation unit 540 outputs a logic low level (L(0)) as the second information B. Therefore, the determining unit 551 of the masking control signal output unit 550 has a logic low level (L(0)) irrespective of the logic level of the first information A outputted from the option processing unit 510. That is, a determination signal outputted from the determining unit 551 has a logic low level (L(0)), which indicates that a current mode is the abnormal mode. Accordingly, the first outputting unit 552 of the masking control signal output unit 550 outputs the masking control signal.

In FIG. 7, the first outputting unit 552 performs a logic AND operation on the gate start signal VST outputted from the gate control signal generation unit 421 and a logic low level (L(0)) outputted from the first determining unit 551. To provide an additional description, the first outputting unit 552 is configured with an AND gate, and two signals inputted to the first outputting unit 552 are the gate start signal VST generated by the gate control signal generation unit 421 and the determination signal outputted from the first determining unit 551, respectively.

Therefore, when the determination signal outputted from the determining unit 551 has a logic low level (L(0)), the first outputting unit 552 always outputs a signal having a logic low level (L(0)) as the masking control signal regardless of the gate start signal VST outputted from the gate control signal generation unit 421. Accordingly, as shown in FIG. 8, the masking control signal having a logic low level (L(0)) is outputted as the gate start signal VST from after the point Y when the falling edge of the third lock signal occurs. An operation, where the outputting unit 552 outputs the masking control signal or various driver control signals according to the determination signal outputted from the determining unit 551, will be additionally described below.

Second, in FIG. 8, after the falling edge point Y of the third lock signal, when the number of frames increases by 1 and thus the number of counted frames is 1, the number of counted frames "1" is the same as the number of gate delays "1", and thus, the second information B having a logic high level (H(1)) is outputted. However, after the falling edge point Y of the third lock signal, since the first information A outputted from the option processing unit 510 still has a logic low level (L(0)), the first determining unit 511 of the masking control signal output unit 550 still outputs a logic low level (L(0)) as the determination signal. Therefore, the first determining unit 511 of the masking control signal output unit 550 continuously outputs a logic low level (L(0)) that is the same as the output signal of the first operation. Accordingly, the gate start signal VST having a logic low level is outputted as the masking control signal.

Third, in FIG. 8, when a rising edge point Z of the third lock signal occurs, the frame counter initialization unit 520 generates an initialization clock, and thus, the frame counter 530 is initialized. Thus, when rising edge point Z of the third lock signal occurs, the number of counted frames again has a value of 0. In this case, since the number of counted frames is 0 and the number of gate delays is set as 1 as described above, the number of counted frames "0" is less than the number of gate delays "1", and thus, the first generator 541 of the masking determination information generation unit 540 outputs a logic low level (L(0)) as the second information B. Therefore, the first outputting unit 552 of the masking control signal output 550 continuously outputs an output signal that is the same as the output signal of each of the first and second operations. That is, the third lock signal EPI_Rx_LOCK has a logic high level at the point Z of FIG. 8 and thus is changed from an abnormal state to a normal state, but even when the third lock signal has been changed to the normal state, by maintaining the abnormal mode for a certain duration, a more stable driver control signal can be outputted. To provide an additional description, the third lock signal is changed to the normal state to the abnormal state and thus the abnormal mode is started, but although the third lock signal is changed from the abnormal state to the normal state, the abnormal mode is not immediately changed to the normal mode. Such a duration difference may be changed according to the number of gate delays that is as described above.

Fourth, in FIG. 8, after the rising edge point Z of the third lock signal, when the number of frames increases by 1 and thus the number of counted frames is 1, the number of counted frames "1" is the same as the number of gate delays "1", and thus, the second information B having a logic high level (H(1)) is outputted. Also, after the rising edge point Z of the third lock signal, the first information A outputted from the option processing unit 510 has a logic high level (H(1)). That is, the first and second information A and B inputted to the first determining unit 551 of the masking control signal output unit 550 have a logic high level (H(1)). Accordingly, the first determining unit 551 outputs a logic high level as the determination signal.

The first outputting unit 552 performs a logic AND operation on the gate start signal VST outputted from the gate control signal generation unit 421 and a logic high level (H(1)) outputted from the first determining unit 551. Therefore, the first outputting unit 552 outputs the gate start signal VST outputted from the gate control signal generation unit 421 as-is. That is, as shown in FIG. 8, after the rising edge point Z of the third lock signal, the gate start signal VST outputted from the gate control signal generation unit 421 is outputted as the output signal of the abnormal mode determination unit 423 from a point S when the number of counted frame becomes 1. In other words, the present invention determines a current mode as the abnormal mode after the falling edge of the third lock signal EPI_Rx_LOCK (i.e., an abnormal state), and thus blocks the output of the gate start signal VST generated by the gate control signal generation unit 421 and outputs the masking control signal having a logic low level. Also, the present invention again determines a current mode as the normal mode after a point S when a time corresponding to one frame elapses from the rising edge of the third lock signal (i.e., a normal state), and thus outputs the gate start signal VST generated by the gate control signal generation unit 421.

As described above, although a logic level is changed to a logic high level at the rising edge point Z of the third lock signal, the present invention does not immediately output the gate start signal VST generated by the gate control signal generation unit 421 but determines a mode as the abnormal mode until a predetermined point (point S) and continuously outputs the masking control signal having a logic low level as the gate start signal.

The third lock signal has a logic high level (H(1)) after the rising edge point Z of the third lock signal, which denotes that the third lock signal is changed from an abnormal state to a normal state. However, as described above, although the third lock signal is changed to a state having a logic high level (H(1)), the present invention continuously maintains the abnormal mode for a predetermined duration (one frame) and thus allows the masking control signal to be outputted, for performing a more stable operation.

Herein, the predetermined duration may be changed by a predetermined first gate delay (Gate_Delay1) value. That is, since the first gate delay (Gate_Delay1) value associated with the gate start signal VST has a value of 1 as described above, the number of counted frames increases by 1 even after the rising edge point Z of the third lock signal, and thus, only when the number of counted frames is the same as the first gate delay value "1", the gate start signal VST generated by the gate control signal generation unit 421 is outputted. Therefore, the masking control signal is continuously outputted during at least one frame even after the rising edge point Z of the third lock signal and, after the point S when a time corresponding to one frame elapses, a normal gate control signal may be outputted.

According to FIG. 8 and the above description, it can be seen that a predetermined duration for output of the gate start signal VST is one frame and determined by the number of gate delays. However, the present invention may change the gate delay value according to the kinds of the driver control signals.

Fifth, the masking determination information generation unit 540 of FIG. 7 includes the first and second generators 541 and 542.

In the first generator 541, as described above, the number of first gate delays (first gate delay value) is set as 1. The driver control signal is controlled by the first generator 541 in output, and is the gate start signal VSR. The polarity signal POL is also controlled by the first gate delay value in output, but its description will be made below.

In the second generator 542 of FIG. 7, the number of second gate delays (Gate_Delay2) is set as 2, and a driver control signal, which is outputted from a third outputting unit 555 connected to the second generator 542 through the second determining unit 554, includes signals GCLK1, GCLK2 and PWM. Therefore, as shown in FIG. 8, the masking control signal is continuously outputted during at least two frames (where the number of counted frames is 0 and 1) even after the rising edge point Z of the third lock signal and, after the point T when a time corresponding to two frames elapses, normal signals GCLK1 and GCLK2 generated by the gate control signal generation unit 421 are outputted as the output signals of the abnormal mode determination unit 423. Although the present invention determines the point of the abnormal mode period using the same lock signal EPI_Rx_LOCK, the end point of the abnormal mode may be set to be changed according to the characteristics of the driver control signals.

According to the present invention, various driver control signals may be outputted according to the kinds of outputting units 552, 553, 555 and 556 connected to the first determining unit 551 or the second determining unit 554.

As described above, in the abnormal mode, the masking control signal makes the gate driving IC 200 not to output an abnormal scan signal only when the gate start signal VST and the clocks GCLK1 and GCLK2 have a logic low level (L).

For this end, as illustrated in FIG. 7, the gate start signal VST outputted from the gate control signal generation unit 421 and the determination signal of the first determining unit 551 are inputted as input signals of the first outputting unit 552, and the clock GCLK1 or GCLK2 outputted from the gate control signal generation unit 421 and the determination signal of the second determining unit 554 are inputted as input signals of the second outputting unit 555.

In the normal mode, since the determination signal having a logic high level (H(1)) is inputted as a first input signal of each of the first and second outputting units 552 and 555, a second input signal VST inputted to the first outputting unit 552 may be outputted as-is, and a second input signal GCLK1 or GCLK2 inputted to the second outputting unit 555 may be outputted as-is.

However, in the abnormal mode, since the determination signal having a logic low level (L(0)) is inputted as the first input signal of each of the first and second outputting units 552 and 555, the first and second outputting units 552 and 555 always output a logic low level (L(0)) irrespective of the second input signal VST of the first outputting unit 552 and the second input signals GCLK1 and GCLK2 of the second outputting unit 555. Accordingly, the gate driving IC 200 cannot output the scan signal because the signals VST, GCLK1 and GCLK2 inputted to the gate driving IC 200 have a logic low level (L(0)).

In addition to the gate start signal VST and the clocks GCLK1 and GCLK2, when the other signals have a logic high level (H) in the abnormal mode, by controlling the driving of the LCD device, various driver control signals (for example, PLK, PWM, etc.) that make the LCD device not to output an abnormal image may also be connected to the outputting units that are configured with an AND gate. The reason that the gate start signal VST and the clocks GCLK1 and GCLK2 are respectively inputted to the different determining units 551 and 554 is because two signals have the different numbers of gate delays as described above.

Only when the masking control signal has a logic high level (H(1)) as the level of the polarity signal POL, the masking control signal makes the data driving IC 300 not to output an abnormal image data signal to the data line, and moreover, only when the gate output enable signal GOE has a logic high level (H(1)), the gate output enable signal GOE makes the gate driving IC 200 not to output an abnormal scan signal.

Therefore, as illustrated in FIG. 7, one of the driver control signals (second input signals) and a first signal (which is generated by inverting the determination signal of the first determining unit 551) are inputted as input signals of the third outputting unit 553 that is configured with an OR gate, and the other of the driver control signals and a first signal (which is generated by inverting the determination signal of the second determining unit 554) are inputted as input signals of the fourth outputting unit 556 that is configured with an OR gate.

In the normal mode, since the determination signal having a logic high level (H(1)) is outputted by the first and second determining units 551 and 554, a signal having a logic low level (L(0)) is inputted as a first input signal of each of the third and fourth outputting units 553 and 556. Since the third and fourth outputting units 553 and 556 are configured with an OR gate, a second input signal POL inputted to the third outputting unit 553 may be outputted as-is, and a second input signal GOE inputted to the fourth outputting unit 556 may be outputted as-is.

However, in the abnormal mode, since the determination signals having a logic low level (L(0)) are respectively outputted by the first and second determining units 551 and 554, a signal having a logic high level (H(1)) is inputted as the first input signal of each of the third and fourth outputting units 553 and 556. At this point, the third and fourth outputting units 553 and 556 configured with an OR gate always output a logic high level (H(1)) irrespective of the second input signals POL and GOE respectively inputted to the third and fourth outputting units 553 and 556. Accordingly, since the signal POL inputted to the data driving IC 300 and the signal GOE inputted to the gate driving IC 200 have a logic high level (H(1)), the data driving IC 300 cannot output an image data signal to the date line, and moreover, the gate driving IC 200 cannot output the scan signal. The reason that the signals POL and GOE are respectively inputted to the different determining units 551 and 554 is because two signals have the different numbers of gate delays as described above.

As described above, the present invention determines the abnormal mode of the LCD device by using various lock signals, and when the abnormal mode occurs, the present invention generates the masking control signal that makes the drivers not to respectively output the abnormal output signals and outputs the masking control signal to the drivers. Accordingly, in the abnormal mode, the drivers disallow the output of an abnormal image.

According to the embodiments, the present invention determines whether the abnormal mode occurs using the lock signal and, when the abnormal mode is determined, outputs the masking control signal to the driver for preventing the driver from outputting the abnormal image signal, in addition to blocking the output of the driver control signal for control of the driver. Accordingly, the present invention can prevent the abnormal driver control signal from being outputted to the driver in the abnormal mode, thus preventing the increase in load applied to the panel.

Moreover, the present invention prevents the scan signal from being outputted to the gate lines in the abnormal mode, and thus can prevent the abnormal image data signal from being charged into the panel by the abnormal gate control signal.

Moreover, the present invention prevents the output of the abnormal gate control signal, and thus can prevent the liquid crystal panel from being damaged due to the abnormal gate control signal.

Moreover, when the abnormal gate control signal outputted in the abnormal mode is too long or short, the power IC can be damaged and thus shut down. However, the present invention prevents the generation of the abnormal gate control signal, thus reducing the above-described damage.

As described above, when the timing controller generates the abnormal driver control signal due to the lock signal that is deactivated to a logic low level by various causes, the present invention masks the abnormal driver control signal as a masking control signal, and thus can prevent abnormal display in the abnormal mode and protect the panel and various circuit elements of the LCD device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A Liquid Crystal Display (LCD) device comprising:

a driver comprising at least one gate driving IC for outputting a scan signal to a plurality of gate lines of a panel, and at least one data driving IC for respectively outputting a plurality of image data signals to a plurality of data lines of the panel; and a timing controller that determines whether a current mode is an abnormal mode in which the panel outputs an abnormal image by using at least one lock signals, wherein the timing controller:

when the current mode is determined as a normal mode, outputs a driver control signal generated for controlling the driver, and when the current mode is determined as the abnormal mode, outputs a masking control signal as a reference signal to the driver which blocks the driver control signal outputted to the gate driving IC, thus prevents the LCD panel from displaying the abnormal image, wherein the determining of an abnormal mode comprises the timing controller:

selects a lock signal, which is used as determination information for determining whether the current mode is the abnormal mode, from the lock signals;

generates a detection clock on the basis of a clock signal and first information which is outputted by the selection;

performs an initialization according to the detection clock, and counts the number of frames;

compares the number of counted frames with the predetermined number of gate delays to generate second information necessary for determining whether to mask the driver control signal as the masking control signal; and determines whether the current mode is the abnormal mode, on the basis of the first and second information.

2. The LCD device of claim 1, wherein the timing controller comprises:

an LVDS reception unit that receives video data and a timing signal from an external system;

a video data alignment unit that realigns the video data to output realigned image data;

an EPI transfer unit that outputs a data control signal and the realigned image data to the data driving IC, the data control signal being generated for driving the data driving IC by using the timing signal; and a control signal generation unit that generates the driver control signal comprising a gate control signal for controlling the gate driving IC and a data control signal for controlling the data driving IC by using the timing signal, determines whether the current mode is the abnormal mode by using the lock signal, and outputs the masking control signal when in the abnormal mode.

3. The LCD device of claim 2, wherein the lock signal comprises at least one of: a first lock signal outputted from the LVDS reception unit; a second lock signal outputted from the EPI transfer unit; and a third lock signal outputted from the data driving IC.

4. The LCD device of claim 3, wherein, the first lock signal comprises information regarding whether a frequency of an input signal inputted from the external system is matched with a frequency of an output signal outputted from the LVDS reception unit, the second lock signal comprises information regarding whether a frequency of an input signal inputted to the EPI transfer unit is matched with a frequency of an output signal outputted from the EPI transfer unit to the data driving IC, and the third lock signal comprises information regarding whether a frequency of an input signal inputted to the last data driving IC of the data driving ICs is matched with a frequency of an output signal outputted from the last data driving IC.

5. The LCD device of claim 4, wherein, the LVDS reception unit comprises a Phase Locked Loop (PLL) outputting the first lock signal, the EPI transfer unit comprises a PLL outputting the second lock signal, and the data driving IC comprises a PLL outputting the third lock signal.

6. The LCD device of claim 2, wherein the control signal generation unit comprises:

a gate control signal generation unit that generates the gate control signal;

a data control signal generation unit that generates the data control signal; and an abnormal mode determination unit that receives the lock signal and the driver control signal which comprises the gate control signal and the data control signal, determines whether the current mode is the abnormal mode, and outputs one of the driver control signal and the masking control signal according to the determined result.

7. The LCD device of claim 6, wherein the abnormal mode determination unit comprises:

an option processing unit that selects a lock signal, which is used as determination information for determining whether the current mode is the abnormal mode, from the lock signals, and outputs first information;

a frame counter that counts the number of frames for outputting the image data;

a frame counter initialization unit that initializes the frame counter on the basis of the first information and a clock signal;

a masking determination information generation unit that compares the number of counted frames, inputs from the frame counter, with the predetermined number of gate delays to generate second information necessary for determining whether to mask the driver control signal as the masking control signal; and a masking control signal output unit that determines whether the current mode is the abnormal mode on the basis of the first and second information, outputs the driver control signal when the current mode is determined as the normal mode, and outputs the masking control signal when the current mode is determined as the abnormal mode.

8. The LCD device of claim 7, wherein, the option processing unit comprises:

a plurality of OR gates respectively connected to the lock signals; and an AND gate connected to the OR gates, and each of the OR gates receives an option comprising information regarding whether to use a lock signal, connected to a corresponding OR gate, as the determination information.

9. The LCD device of claim 7, wherein the frame counter initialization unit detects a rising edge or falling edge of the first information to output a detection clock, and initializes the frame counter with the detection clock.

10. The LCD device of claim 7, wherein the masking control signal output unit comprises:

a determining unit comprising an AND gate receiving the first and second information, and determining whether the current mode is the abnormal mode; and an outputting unit outputting the driver control signal when a determination signal outputted from the determining unit is a signal indicating the normal mode, and outputting the masking control signal when the determination signal is a signal indicating the abnormal mode.

11. The LCD device of claim 10, wherein, the masking determination information generation unit comprises two or more generators comparing the different numbers of gate delays with the number of counted frames, the determining unit is provided in plurality to be respectively connected to the generators, and the outputting units, respectively connected to the determining units, output different driver control signals.

12. The LCD device of claim 10, wherein each of the outputting units comprises at least one of: an AND gate receiving a determination signal outputted from a corresponding determining unit and the driver control signal; and an OR gate receiving the driver control signal and a signal for inverting the determination signal.

13. A driving method of a Liquid Crystal Display (LCD) device, the driving method comprising:

generating a driver control signal which comprises a gate control signal for controlling a gate driving IC and a data control signal for controlling a data driving IC, by using a timing signal inputted from an external system;

realigning video data inputted from the external system;

using at least one lock signal, determining whether a current mode is an abnormal mode in which a panel outputs an abnormal image; and when the current mode is determined as a normal mode, outputting the driving control signal to a driver, and when the current mode is determined as the abnormal mode, outputting a masking control signal as a reference signal to the driver which blocks the driver control signal outputted to the gate driving IC, thus prevents the LCD panel from displaying the abnormal image, wherein the determining of an abnormal mode comprises:

selecting a lock signal, which is used as determination information for determining whether the current mode is the abnormal mode, from the lock signals;

generating a detection clock on the basis of a clock signal and first information which is outputted by the selection;

performing an initialization according to the detection clock, and counting the number of frames;

comparing the number of counted frames with the predetermined number of gate delays to generate second information necessary for determining whether to mask the driver control signal as the masking control signal; and determining whether the current mode is the abnormal mode, on the basis of the first and second information.

14. The driving method of claim 13, wherein the lock signal comprises at least one of: a first lock signal outputted from an LVDS reception unit which is comprised in a timing controller; a second lock signal outputted from an EPI transfer unit which is comprised in the timing controller; and a third lock signal outputted from the data driving IC.

15. The driving method of claim 14, wherein, the first lock signal comprises information regarding whether a frequency of an input signal inputted from the external system is matched with a frequency of an output signal outputted from the LVDS reception unit, the second lock signal comprises information regarding whether a frequency of an input signal inputted to the EPI transfer unit is matched with a frequency of an output signal outputted from the EPI transfer unit to the data driving IC, and the third lock signal comprises information regarding whether a frequency of an input signal inputted to a last data driving IC of a plurality of data driving ICs is matched with a frequency of an output signal outputted from the last data driving IC.

16. The driving method of claim 15, wherein the selecting of a lock signal comprises:

performing a logic OR operation on each of the locks and a pair of options which comprise information regarding whether to use the lock signals as the determination information; and performing a logic AND operation on result signals of the logic OR operation to generate the first information.

17. The driving method of claim 15, wherein the detection clock is generated by detecting a rising edge or falling edge of the first information.

18. The driving method of claim 15, wherein the determining of the abnormal mode on the basis of the first and second information comprises performing a logic AND operation on the first and second information to generate a determination signal.

19. The driving method of claim 18, wherein the outputting of the driving control signal or a masking control signal comprises outputting the driver control signal when the determination signal is a signal indicating the normal mode, and outputting the masking control signal when the determination signal is a signal indicating the abnormal mode.

20. The driving method of claim 19, wherein, the generating of second information comprises comparing the different numbers of gate delays with the number of counted frames to generate a plurality of the second information, the determining of the abnormal mode on the basis of the first and second information comprises performing a logic AND operation on the first information and the plurality of second information to generate a plurality of the determination signals, and the outputting of the driving control signal or a masking control signal comprises outputting different driver control signals according to the plurality of determination signals.

* * * * *